US006049077A

United States Patent [19]

Franzen

[11] Patent Number: 6,049,077

[45] Date of Patent: Apr. 11, 2000

[54] TIME-OF-FLIGHT MASS SPECTROMETER WITH CONSTANT FLIGHT PATH LENGTH

[75] Inventor: Jochen Franzen, Bremen, Germany

[73] Assignee: Bruker Daltonik GmbH, Bremen, Germany

[21] Appl. No.: 09/133,868

[22] Filed: Aug. 13, 1998

[30] Foreign Application Priority Data

Sep. 2, 1997 [DE] Germany ..... 197 38 187

[51] Int. Cl.[7] ..... H01J 49/40

[52] U.S. Cl. ..... 250/287

[58] Field of Search ..... 250/287, 286

[56] References Cited

U.S. PATENT DOCUMENTS

| | | | |
|---|---|---|---|
| 4,032,782 | 6/1977 | Smith et al. | 250/292 |
| 5,382,793 | 1/1995 | Weinberger et al. | 250/288 |
| 5,719,392 | 2/1998 | Franzen | 250/287 |

FOREIGN PATENT DOCUMENTS

| | | |
|---|---|---|
| 2147140 | 5/1985 | United Kingdom . |
| 2217103 | 10/1989 | United Kingdom . |
| 2317266 | 3/1998 | United Kingdom . |

*Primary Examiner*—Kiet T. Nguyen

[57] ABSTRACT

The time-of-flight mass spectrometers which must demonstrate a high constancy of the calibrated mass scale even under changeable ambient temperatures and thermal loads due to pumps or electronics. Time-of-flight mass spectrometers calculate the masses of ions from the measured time of flight in a long flight tube that is normally manufactured of stainless steel. These flight tubes are subject to temperature-related length changes which affect the flight time and therefore the mass determination. The thermal expansion of spectrometer parts between ion source and ion detector, thus keeping the flight path for the ions at a constant length. Length compensation can be produced by design of the spacing system made of materials of different thermal expansion coefficients, the length changes of which balance out in opposite directions.

8 Claims, 2 Drawing Sheets

TIME-OF-FLIGHT MASS SPECTROMETER WITH CONSTANT FLIGHT PATH LENGTH

FIELD OF INVENTION

Figure 1:
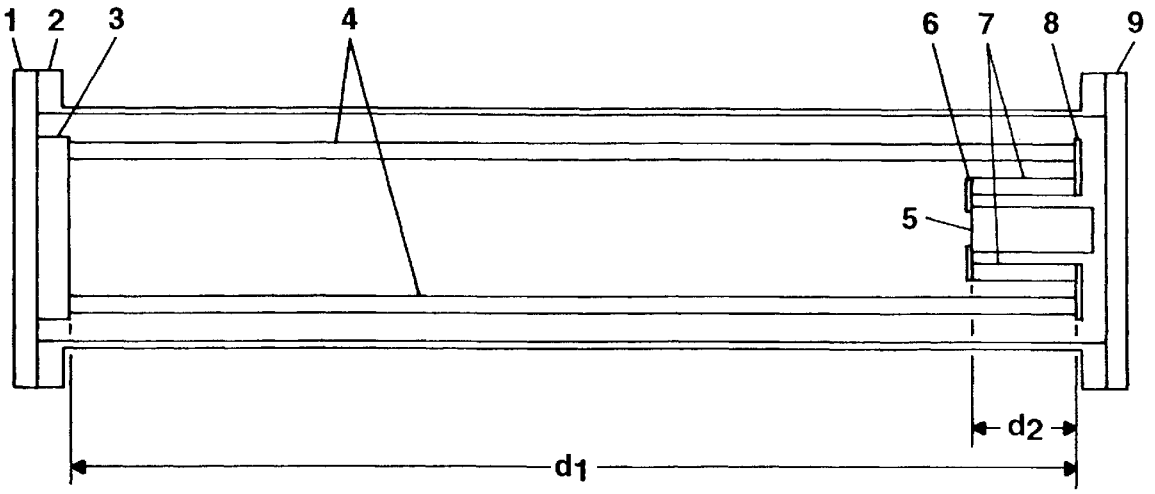

The invention relates to time-of-flight mass spectrometers which must demonstrate a high constancy of the calibrated mass scale even under changeable ambient temperatures and thermal loads due to pumps or electronics. Time-of-flight mass spectrometers calculate the masses of ions from the measured time of flight in a long flight tube that is normally manufactured of stainless steel. These flight tubes are subject to temperature-related length changes which affect the flight time and therefore the mass determination.

PRIOR ART

The principle of function of time-of-flight mass spectrometers can be understood very easily, compared with that of other mass spectrometers, even though the practical realizations in this category of mass spectrometers are similarly complicated as in other categories. The ions of the analyte substance, formed in an ion source in a very short timespan of only a few nanoseconds, are all accelerated in relatively short acceleration fields to the same energy per ion charge. They then fly through a field-free flight path and are measured at the end by a temporally high-resolution ion detector as a temporally varying ion current. The flight time of the various ion types can be determined from these measurement signals.

Using the very simple basic equation for the kinetic energy of singly charged ions $$E=\tfrac{1}{2}m\,v^2, \tag{1}$$

their mass m can be determined from their velocity v at equal energy E for all ions. Almost the same applies to multiply charged ions by which however only the mass-to-charge (m/z) ratio can be determined. The velocity v of the ions is, as suggested above, provided in a flight tube of the length L using the measurement of the flight time t of the ions according to the equation $$v=L/t. \tag{2}$$

Thus from the flight time it is simple to calculate the mass m, indicated again for singly charged ions:

$$m=2\,E\,t^2/L^2=c\times t^2. \tag{3}$$

For a very precise determination of the ion mass, the above equations become more complicated since, due to the ionization process, the ions in the ion source are given initial energies from the ionization process inevitably before their electric acceleration, which slightly, though decisively changes the equation (3). In this way, the relationship between mass m and the square of the flight time $t^2$ is slightly nonlinear. This relationship is therefore normally determined experimentally and stored in a computer for future determinations of the mass as a so-called "mass scale".

In this context the term "mass scale" is defined as the assignment of precise mass values to the ions, performed by a connected computer system, calculated from the flight time signals via a calibration curve (more precisely: values of the mass-to-charge ratios). The mass scale calibration curve is measured by a special calibration method using precisely known reference substances and should remain stable for as long as possible without recalibration.

Generally, a large number of influences affect the stability of the mass scale calibration curve: inconstancy of the high voltages for acceleration of the ions, variable spacing of the acceleration diaphragms in the ion source caused by the mounting of sample supports introduced into the vacuum, variable initial energies of the ions due to the ionization process, and not least, thermal changes in the length of the flight path.

For highly precise measurements of the masses of an unknown analyte substance, the mass of a known reference substance is therefore measured at the same time in the same mass spectrum, whereby the reference substance must be added to the analyte substance ("measurement method with internal reference"). If the so assigned mass of the reference substance deviates from the true, known mass value, the assigned mass for the analyte ions can then be corrected in a known manner (for this, see application DE 196 35 646, for example).

Unfortunately, the different physical influences have different effects on the mass. Changes in the high voltage, for example, cause a proportional change in the energy E of the ions, producing proportional mass changes according to equation (3). Changes to the flight length L, however, enter into the mass calculation according to equation (3) proportionate to the root of the mass. Thus, if the reference mass and analysis mass are largely different, a successful correction of the analyte mass is no longer possible without precise knowledge of the type of influence. If the masses of the analyte substance and reference substance are very similar, a correction can still be made with relatively good success. Nowadays, mass accuracies of 10 parts per million (ppm) are achieved using high performance time-of-flight mass spectrometers; however, mass accuracies of 5 ppm and better are the goal of protein chemists (and other users) and are demanded from manufacturers of mass spectrometers.

The stainless steel flight tubes standard today, which determine the spacing between the ion source and ion detector, have thermal expansion coefficients of about $\alpha=13\times10^{-6}\ K^{-1}$. The more rarely used Duraluminium even demonstrates an expansion of $\alpha=23\times10^{-6}\ K^{-1}$. Since a relationship $$dm/m=-2\,dL/L \tag{4}$$

can be derived from equation (3), an apparent mass change of about 26 ppm results per degree Celsius of temperature change due to expansion of the stainless steel flight tube. Compared with the target value of 5 ppm for the mass accuracy, that is an extremely high apparent mass change. Therefore today, in the case of highest demands on the accuracy of the mass determination, a temperature-dependent mass calibration is required, which is however very complicated to perform and requires a very precise temperature measurement at a very constant room temperature and very constant energy load by the spectrometer electronics.

The ambient temperature in rooms without air-conditioning varies by more than 10 degrees Celsius. There are however even greater stresses from today's strict requirements regarding electromagnetic compatibility (EMC) which, in conjunction with this pulsed method for ion generation, forces a design where the flight tube of the mass spectrometer and the electronics are built into a hermetically sealed housing. Due to heating of the vacuum pumps and the electronics, temperature increases for the flight tube of up to 40 degrees Celsius can be figured on, in spite of fan cooling. Without corresponding corrections, this corresponds to an apparent mass change of about 1,000 ppm for measurements during the warm-up phase of the instrument. But even when equilibrium is achieved, thermal fluctuations in the range of about 10 degrees Celsius and corresponding apparent mass changes of 260 ppm remain. On the other hand, use of coolant water is undesirable today for ecological and cost reasons. Even for measurement methods with internal reference, difficulties result here when deciding on the right correction to use.

For routine analysis with tens of thousands of samples daily, such as is expected for DNA analysis, mass determination with an internal reference is too costly, since it requires the addition of respective mass-similar reference substances to every single sample. For these methods (which are not however subject to the above-mentioned extreme demands on the accuracy of the mass determination), the goal is to keep all operating parameters as constant as possible in order to perform the mass determination without reference substances and obtain a long duration of validity for the mass calibration.

As a solution to this problem of apparent mass changes due to temperature changes, controlled temperature stabilization of the flight tube including ion source and detector is an option. The stability should be in the range of ±1/10 degrees Celsius according to the above-mentioned strict demands on mass constancy. While it can be lower for routine mass spectrometers, installation of a controlled temperature stabilization is not simple however due to the standard flight tube lengths of 1 to 2 meters and has not yet been realized.

The problem solution already described above using temperature-dependent calibration of the mass scale has already been applied, however it is very complicated. It could be automated by automatic measurement of temperature, although this solution has also not yet been realized. Temperature-dependent calibration becomes more difficult because the flight tube demonstrates normal temperature gradients along its axis due to irregular heating or cooling with temperature changes.

Compensation using temperature-controlled regulation of the voltages is, as described above, not possible due to the varying functional effect on the mass scale.

Mechanical control of the spacing between the ion source and detector using electromechanical actuators seems possible, although it has not yet been introduced. To do this, either a very precise length measurement is required or—more simply—the use of reference substances which need not be scanned in the same spectrum and therefore can be added separately to the ion source ("external reference").

However, all these solutions require active control systems which always complicate the function of the mass spectrometer and raise the cost of its operation.

OBJECTIVE OF THE INVENTION

It is the objective of the invention to design a time-of-flight mass spectrometer in such a way that, with unavoidable thermal expansion of the spectrometer parts due to temperature changes, the flight path length remains constant so that there is no change in the relationship between the flight times and precise mass values which extends beyond analysis-specific tolerances.

DESCRIPTION OF THE INVENTION

It is a basic idea of the invention to thermally stabilize the spacing structure between the ion source and detector of a linear time-of-flight mass spectrometer using a special, compensating spacing system made of materials with different expansion coefficients. This stabilization of spacing has been known in principle for a long time and is applied for example to clock pendulums (e. g. Riefler compensation pendulum). To do this, it is advantageous to decouple the spacing structure between ion source and detector mechanically from the flight tube that produces the spacing in state-of-the-art designs and additionally maintains the vacuum in the mass spectrometer. It is however also possible to construct the flight tube from a material with very low thermal expansion coefficients and incorporate this into the spacing stabilization.

For time-of-flight mass spectrometers with ion reflectors with which the ions are reflected towards a detector with a special velocity focusing, the length stabilization is installed for both the now two field-free flight paths.

Also the length of the acceleration paths in the ion source, which are normally relatively short compared to the flight path, and the spacings of the aperture electrodes in ion reflectors can be length stabilized, either by selection of spacer materials with expansion coefficients close to zero, or according to the same basic principle of compensation. In spite of the short length, they have a strong influence on the flight time due to much lower velocities of the ions in these spectrometer parts.

Materials are known which demonstrate a thermal expansion coefficient of almost zero (for example, glass ceramic materials such as Ceran® or Zerodur®). These can advantageously be used for short spacers, however, they are generally too brittle and fragile for the production of long spacing structures. Thus they can be used as space-retaining isolators in ion sources or ion reflectors. Materials which are solid and robust enough for long spacers (such as the metal alloys Invar® or Vacodil® 36, for example) have a low but non-neglectable thermal expansion, which requires a certain length of a compensation material with a high expansion coefficient for counteracting compensation of the residual expansion.

SHORT DESCRIPTION OF THE FIGURES

FIG. 1 shows the principle of a linear time-of-flight mass spectrometer with a stabilization of the flight path length according to this invention. The flight tube (2) is closed by flanges (1) and (9) and evacuated, whereby the pump is not shown here. The short ion source (3) is mounted on flange (1). Attached to it are long spacing rods (4) of material with a very low thermal expansion. At the end of the spacing rods (4), the ion detector (5) is attached via the two retaining rings (6) and (8) and the compensation rods (7) with a high thermal expansion. The high thermal relative expansion of the short compensation rods (7) compensates exactly the low relative expansion of the long spacing rods (4). All voltage input glands and also the additional equipment for ionization in the ion source (such as lasers and the associated mirror and lens systems, for example) have been omitted from FIG. 1 for reasons of improved clarity.

Figure 2:
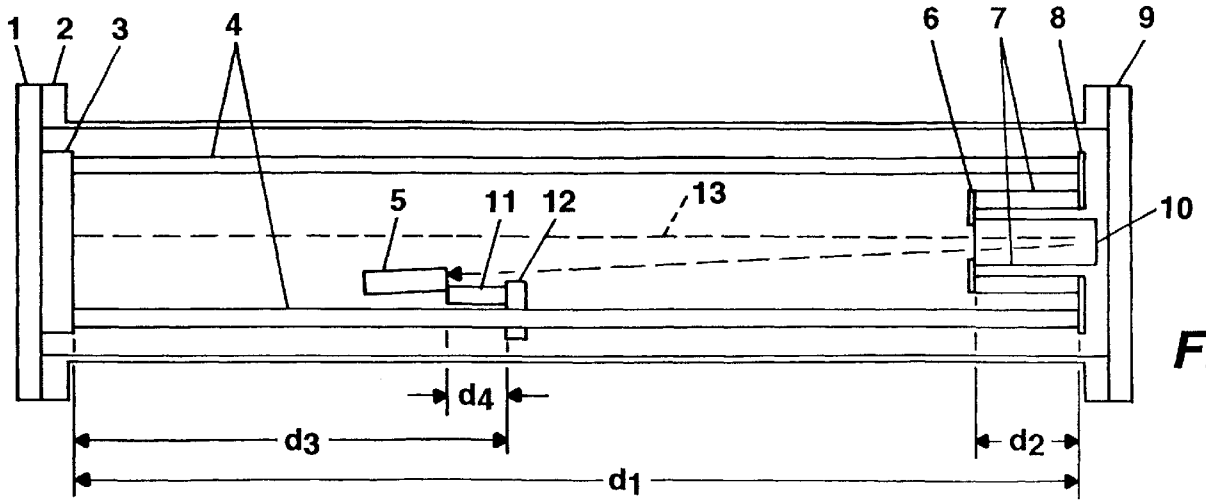

FIG. 2 shows the schematic of a time-of-flight mass spectrometer with an energy focusing reflector (10). The flight path (13) leads from the ion source (3) to the reflector (10) and back again to the detector (5), which is now located at the end of the second flight path (9). The detector (5) is again attached via a compensation rod (11) and spacer (12) in such a way to the spacing rods (4) that its distance from the ion source (3) and thus the total flight path remains constant.

Figure 3:
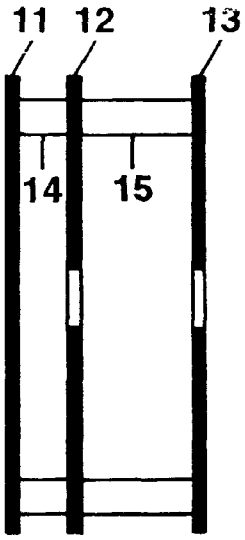

FIG. 3 shows an ion source with sample electrode 11, intermediate acceleration electrode 12, ground acceleration electrode 13, and acceleration electrode spacers 14 and 15.

Figure 4:
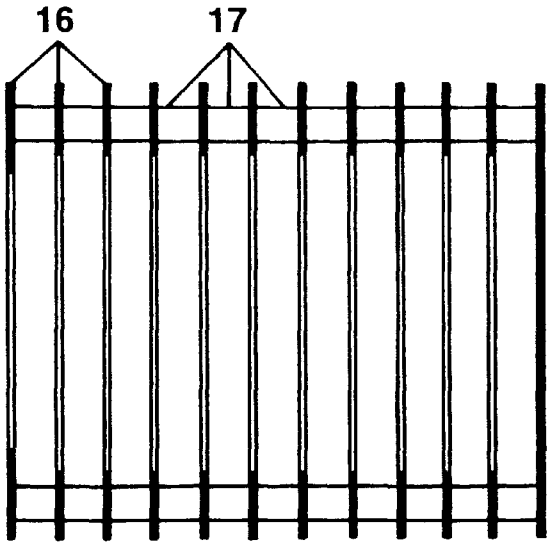

FIG. 4 presents a simple model of an ion reflector with aperture electrodes 16, and electrode spacers 17.

FAVORABLE EMBODIMENTS

An ideal embodiment would consist of using spacers (or flight tubes) between the ion source and ion detector without any thermal expansion. Materials almost without any thermal expansion are known. Primary among these are the glass ceramic materials as Ceran® or Zerodur® which demonstrate practically no thermal expansion in a range between room temperature and several hundred degrees Celsius. But quartz glass as well has a very low relative linear expansion coefficient of only $\alpha=0.5\times10^{-6}$ $K^{-1}$. All these materials are however brittle and fragile so they are not suitable for the production of long spacing structures in the order of 50 to 200 cm. Therefore stable materials such as metals must be used. Among the metals, Invars or the similar Vacodil® 36 have a very low expansion coefficient of only $\alpha=1.5\times10^{-6}$ $K^{-1}$, while the stainless steels usually preferred for the flight tubes for reasons of vacuum engineering have a much higher thermal coefficient of about $\alpha=13\times10^{-6}$ $K^{-1}$ (and higher). Therefore, when using Invar or Vacodil 36, the residual expansion must be taken into account and compensated for.

In FIG. 1, a time-of-flight mass spectrometer with such a compensation according to this invention is shown schematically. The flight path is here no longer simply given by the flight tube, as is state of the art, bearing the ion source at one end and the ion detector at the other. In conrast, the flight path is defined by three or four parallel rods (4) made of a low expansion material (such as Invar), the expansion of which is however precisely balanced out by the compensation rods (7) made of a material with a high expansion coefficient, for example a stainless steel.

According to FIG. 1, the flight length $(d_1-d_2)$ can then be kept precisely constant if expansion of the spacing rods with a length of $d_1$ is exactly compensated for in the opposite direction by expansion of the compensation rods $d_2$. Therefore, the following equation applies to both expansions:

$$\alpha_1\times d_1=\alpha_2\times d_2, \tag{5}$$

whereby $\alpha_1$ and $\alpha_2$ are the expansion coefficients of the two materials used. From this condition, the length $d_2$ can be calculated. If, for example, Invar with a coefficient of $\alpha_1=1.5\times10^{-6}$ $K^{-1}$ and a stainless steel with $\alpha_2=15\times10^{-6}$ $K^{-1}$ are used, both lengths $d_2$ and $d_1$ must also represent the ratio 1:10.

In FIG. 1, the spacing rods are mounted within the vacuum system. This arrangement appears especially favorable since heating of the rods in the vacuum proceeds very slowy and therefore very uniformly. If, additionally, the spacing rods (4) are thermally isolated from the ion source (3), resultant heating of the entire retaining system essentially proceeds via radiation compensation without the occurrence of disturbing temperature gradients.

The spacing rods can of course also be attached outside the vacuum system, i.e. outside the flight tube, whereby however the flight tube must be provided with a metal bellow to absorb the expansion compared to the low expansion of the retaining rods. The retaining rods can for example be attached between the flanges (1) and (9), whereby expansion of the flanges must correspondingly be taken into account. Any specialist can compensate for more complicated expansion cases according to the above given information. The advantage of such a structure is that the detector, mounted to its flange, can easily be exchanged. Naturally, the spacing rods can be fastened to the flanges of the flight tube even inside the vacuum.

In FIG. 2 it is schematically shown that an energy focusing time-of-flight mass spectrometer with an ion reflector with exact length compensation can also be constructed. It is presumed here that the reflector is already built to be longitudinally stable, which can be achieved for example using insulating spacing materials such as Zerodur. Here the two linear flight lengths $(d_1-d_2)$ and $(d_1+d_4-d_2-d_3)$ are compensated for at the same time if the length $d_4$ of the compensation rods (11) just compensates in temperature for the partial length $d_3$ of the retaining rods (4):

$$\alpha_1\times d_3=\alpha_4\times d_4, \tag{6}$$

Even in this case, the spacing rods may be arranged outside the flight tube, whereby however the flight tube must then have two metal bellows to absorb the expansions and the detector must be located in the tube part between the bellows.

The ion sources used in time-of-flight mass spectrometry are usually very short, as shown in FIG. 3. For example, for the ionization of macromolecules using the method of matrix assisted laser desorption (MALDI), normally two acceleration paths with lengths of only three and twelve millimeters are used. In spite of this, a length change must not be neglected because the ions remain longer in the acceleration path (particularly in the first).

The distances between the acceleration electrodes in the ion source could however also be designed to be thermally stable. Either the above-named glass ceramics or quartz glass can be used as insulating spacers. Or the spacings can be kept constant according to the same principles which have already been presented in detail for the flight path.

The same applies for the spacings between the apertures in the standard ion reflectors with or without built-in grids. A simple model of such a reflector is presented in FIG. 4. To generate a homogeneous reflection field inside the ion reflector, larger numbers of apertures with linearly ascending countervoltages are installed. Also in this case the spacers should be made from materials with expansion coefficients close to zero.

Any specialist in the field will be capable to make the appropriate calculations according to the indicated principles, even if the retaining elements should be a combined structures of various materials, or if flanges and other equipment parts of various materials are added. Since however the temperature coefficients of materials indicated in tables or even by the manufacturer are often not correct, it is always better to experimentally analyze the found optimum design for stability of the mass scale and, if necessary, to make corresponding corrections to the design.

Naturally the spacers may be shaped differently from the column form shown in FIGS. 1 and 2. Any form can be used without invalidating the principles given here. In particular, the flight tubes themselves can be used as retainers, for example. However, since materials such as Invar or Vacodil 36 are very difficult to work on and are not available in the form of tubes, such a solution is not cost-effective.

Any specialist in the field of time-of-flight mass spectrometers will be able to draft and produce even more complicated designs of spectrometers using the basic principles given here, so that the mass scale can remain constant even with temperature changes in the mass spectrometric structure.

I claim:

1. Time-of-flight mass spectrometer for precise mass determinations of ions by measuring their precise flight time, comprising an ion source, an ion detector, and a spacing structure defining an ion flight path between the ion source and the ion detector, wherein the length of the flight path is kept constant during temperature changes of the spectrometer by a thermally length-invariable spacing structure.

2. The mass spectometer as claimed in claim 1, wherein the spacing structure either consists of spacing elements without thermal expansion or of a combination of long spacing elements with low thermal expansion and short spacing elements with higher thermal expansion which compensate any length change of their combined length in a counteracting way.

3. The mass spectometer as claimed in claim 1 in the form of a simple linear time-of-flight mass spectrometer with a single linear field-free ion flight path between the ion source and the ion detector, wherein the length of the single field-free ion flight path between the ion source and ion detector is kept constant, during temperature changes, by a spacing structure made of materials of different thermal expansion.

4. The mass spectometer as claimed in claim 1 in the form of an energy focusing time-of-flight mass spectrometer with two linear field-free flight paths before and after an ion reflector, wherein both the length of the first field-free flight path before the reflector as well as the length of the second field-free flight path after the reflector are kept constant, during temperature changes, by spacing structures made of materials of different thermal expansion.

5. The mass spectometer as claimed in claim 4 comprising an energy focusing ion reflector consisting of field-forming electrodes held in distance by spacers, wherein the spacers are designed to be length-invariable during temperature changes.

6. The mass spectometer as claimed in claim 5, wherein the spacers in the energy focusing reflector are made of material with thermal expansion coefficient close to zero.

7. The mass spectometer as claimed in claim 1 comprising an ion source with acceleration electrodes and spacers, wherein the spacers of the ion source electrodes are designed to be length-invariable during temperature changes.

8. The mass spectometer as claimed in claim 7, wherein the spacers of the ion source electrodes are made of material with thermal expansion coefficient close to zero.

* * * * *